US005290182A

United States Patent [19]

Mondelop

[11] Patent Number: 5,290,182

[45] Date of Patent: Mar. 1, 1994

[54] BOAT PROPELLING ASSEMBLY

[76] Inventor: J. Luis A. Mondelop, R. Carvalho Mendonca, 275 CEP 11070, Brazil

[21] Appl. No.: 940,288

[22] Filed: Sep. 3, 1992

[51] Int. Cl.[5] ..... B63H 5/12

[52] U.S. Cl. ..... 440/57; 440/63; 440/83

[58] Field of Search ..... 114/144 R; 440/38, 40, 440/42, 49, 53, 57, 61, 63, 83

[56] References Cited

U.S. PATENT DOCUMENTS

| | | | |
|---|---|---|---|
| 1,863,940 | 6/1932 | Ranke | 440/59 |
| 2,415,183 | 2/1947 | Law . | |
| 2,956,536 | 10/1960 | Kilvington | 440/59 |
| 3,933,116 | 1/1976 | Adams et al. . | |
| 4,544,362 | 10/1985 | Arneson . | |
| 4,544,363 | 10/1985 | Govan . | |
| 4,645,463 | 2/1987 | Arneson . | |
| 4,728,308 | 3/1988 | Weismann | 440/57 |
| 5,167,548 | 12/1992 | Thiger | 440/53 |

FOREIGN PATENT DOCUMENTS

| | | | |
|---|---|---|---|
| 407630 | 1/1991 | European Pat. Off. | 440/57 |

*Primary Examiner*—David M. Mitchell
*Assistant Examiner*—Stephen P. Avila
*Attorney, Agent, or Firm*—Cushman, Darby & Cushman

[57] ABSTRACT

A boat propelling assembly includes a single support unit which includes a thrust articulation and horizontal and vertical movement members controlled by a horizontal actuation element. Manual or automatic inclination control is also provided by a control system to determine the inclination of the propelling member to which the propeller is engaged, so as to keep the propeller totally or partially submerged.

23 Claims, 8 Drawing Sheets

BOAT PROPELLING ASSEMBLY

BACKGROUND OF THE INVENTION

This invention relates to propelling assemblies for engine-driven boats, and more particularly to a propelling system which incorporates steering and propeller submersion control into a single control system.

Propelling assemblies for engine-driven boats have been developed over time in a plurality of forms seeking the best results and manners for the transmission of power from the engine to the pusher propeller itself.

It is not the object of the present invention to describe such a plurality of forms which, for the purpose of example only, could be described as a single shaft extending lengthwise the boat member or as other more intricate and expensive forms consisting of reduction gears, engaging/disengaging means, reverse gears, shaft and propeller, all integrated in a single assembly.

For a clearer understanding of the object of the present invention, it is important that the propelling systems are distinguished by the submersion of the propeller into the water. The usual propelling system suggests a propeller be entirely submerged into the water and sized in a manner to achieve the best possible result, with the propeller itself always kept submerged during operation.

Nevertheless, over the last decades, in the search of higher and higher speeds with greater efficiency, surface propellers have been developed which basically differ from the conventional submerged propellers in their design, which are intended to operate efficiently both submerged or on the water surface, i.e., generating thrust in an efficient manner even when only partially submerged.

The advantage of these propellers, when operated in partial submersion, is the ability to reduce the propeller forward area submerged portion, which, by moving along with the boat, generates a passive power which is much lower than that of the totally submerged propeller.

The significant advantage resulting from such a feature has been absorbed very quickly in the development of the propelling systems by employing surface propellers, although the drawback thereof is low efficiency when the operation is performed in a half-submerged condition under very low speeds. A further drawback is the initial motion of the boat departure.

Conventional system, designed to overcome such difficulties include articulated propelling members wherein the shaft and propeller can be moved and adjusted by two independent systems; one system intended to vertically set the submersion level of the propeller and the other system to use such articulation in the horizontal movement in order to promote the boat steering action.

In this type of assembly, the above described deficiency is resolved by lowering the propelling assembly to a vertical position and thus turning the surface propeller into a submerged propeller on a temporary basis.

If manually operated by a control panel, this process permits the proper adjustment of the submersion level according to the boat speed and makes good use of the propeller efficiency by reducing its displacement-resistant forward area.

Some examples of such propelling systems are objects of U.S. Patents like the one shown in FIG. 1 of U.S. Pat. Nos. 4,544,362 and 4,645,463 and others similarly shown in U.S. Pat. Nos. 2,415,183 and 3,933,116. However, all of these conventional systems present some of the inconveniences described below, or all the inconveniences as in the case of FIG. 1 of U.S. Pat. No. 4,544,363.

Such inconveniences are:

a) The requirement of a pump hydraulic system to perform the manual control of the submersion level.

b) The need of a frequent interference with the hydraulic control to obtain the propeller optimization by adjusting the submersion level.

c) Low reliability of the steering system since the hydraulic system is not protected against external agents, being constantly subjected to the water corrosive actions on the boat external side.

d) Technical-economical infeasibility for the adoption of a mechanical/hydraulic or mechanical system for the steering actuation, since it is constantly submerged into the water.

e) The inoperative condition of the assembly in case of external leakages either in the steering hydraulic system or in the submersion level adjustment hydraulic system.

f) The inoperative condition of the assembly in any case of failure in the submersion level adjustment hydraulic system.

g) Intricate installation due to the assembly of the steering and level control systems which is carried out totally apart from the propelling assembly.

SUMMARY OF THE INVENTION

It is an object of the present invention to provide a propelling assembly articulated with the boat stern which, in addition to efficient use of surface propellers, can also operate with such surface propellers totally submerged without the inconvenience previously mentioned. The propelling assembly is connected to the external lower side of the boat stern, and is provided with a steering actuation system and a submersion level actuation system integrated in a single actuation member. The steering system is properly protected in the boat's internal side and can be actuated either by mechanical or mechanical/hydraulic means.

A second object of the invention is related to mechanical improvements in the assembly of the components into the articulation support box for a greater reliability and easy installation.

A third object of the invention is to integrate the articulation of the control members and that of the propelling shaft in a single member, to facilitate the assembly installation.

A fourth object of the invention is to improve the inlet shaft and the torque intake that comes from the engine for a greater reliability and facility of assembly.

A fifth object of the invention is to provide the propelling member with longitudinal flaps at the end adjacent to the propeller for the obtention of actions to be used for automatic actuation of the propeller submersion level control system according to the boat speed.

A sixth object of the invention is to provide the submersion level control system with automatic actuation means, without the need of a pump hydraulic control, to operate together with the action of the flaps connected to the propelling member.

A seventh object of the invention is to provide the submersion level control with pump hydraulic means for the option of manual operation, without impairing the presence of the aforementioned automatic control.

DETAILED DESCRIPTION OF THE PRESENTLY PREFERRED EMBODIMENT

Figure 1:
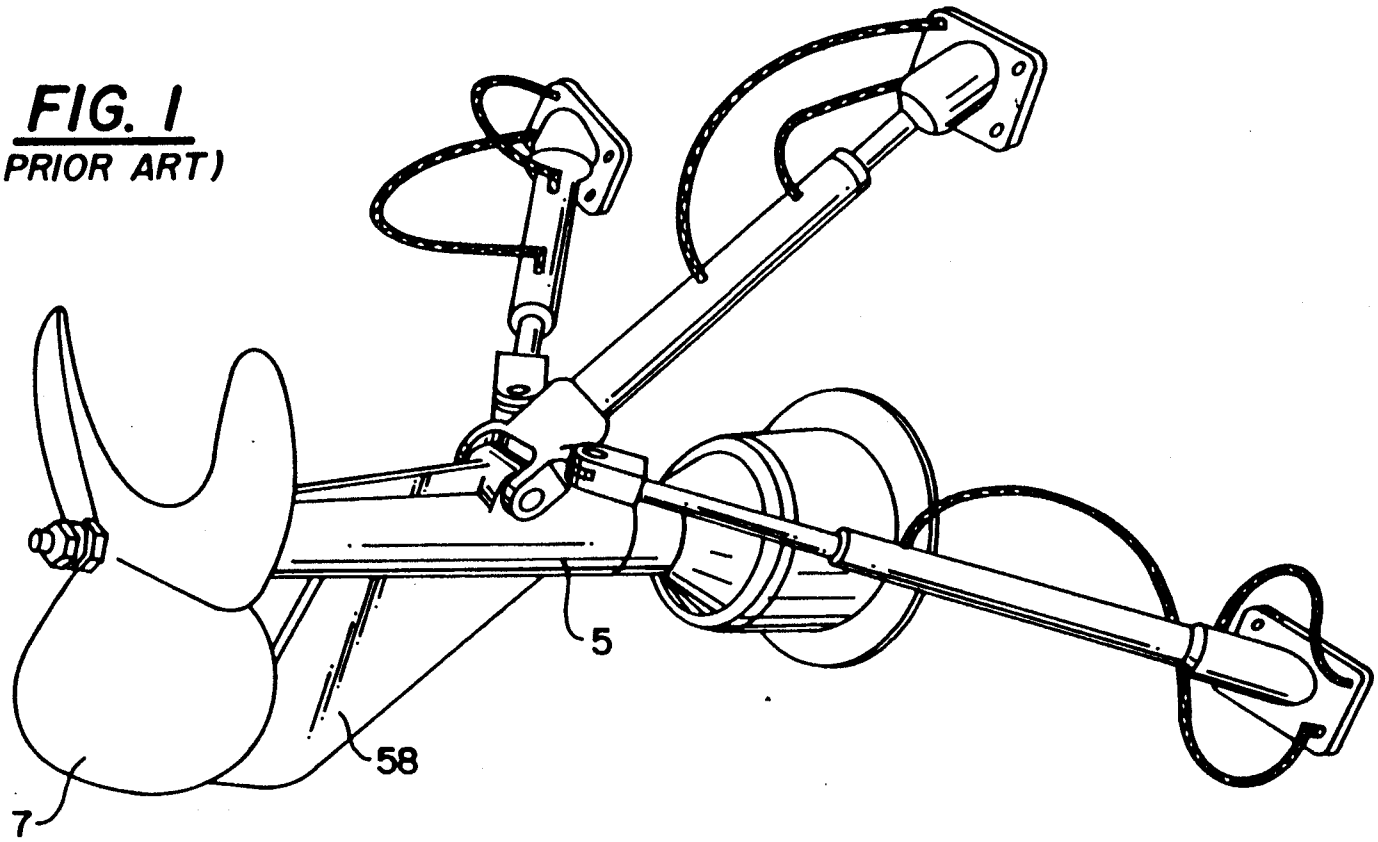
FIG. 1 (PRIOR ART)
FIG. 1 is a perspective view of a conventional propeller consisting of independent controls for steering and submersion level.
Figure 2:
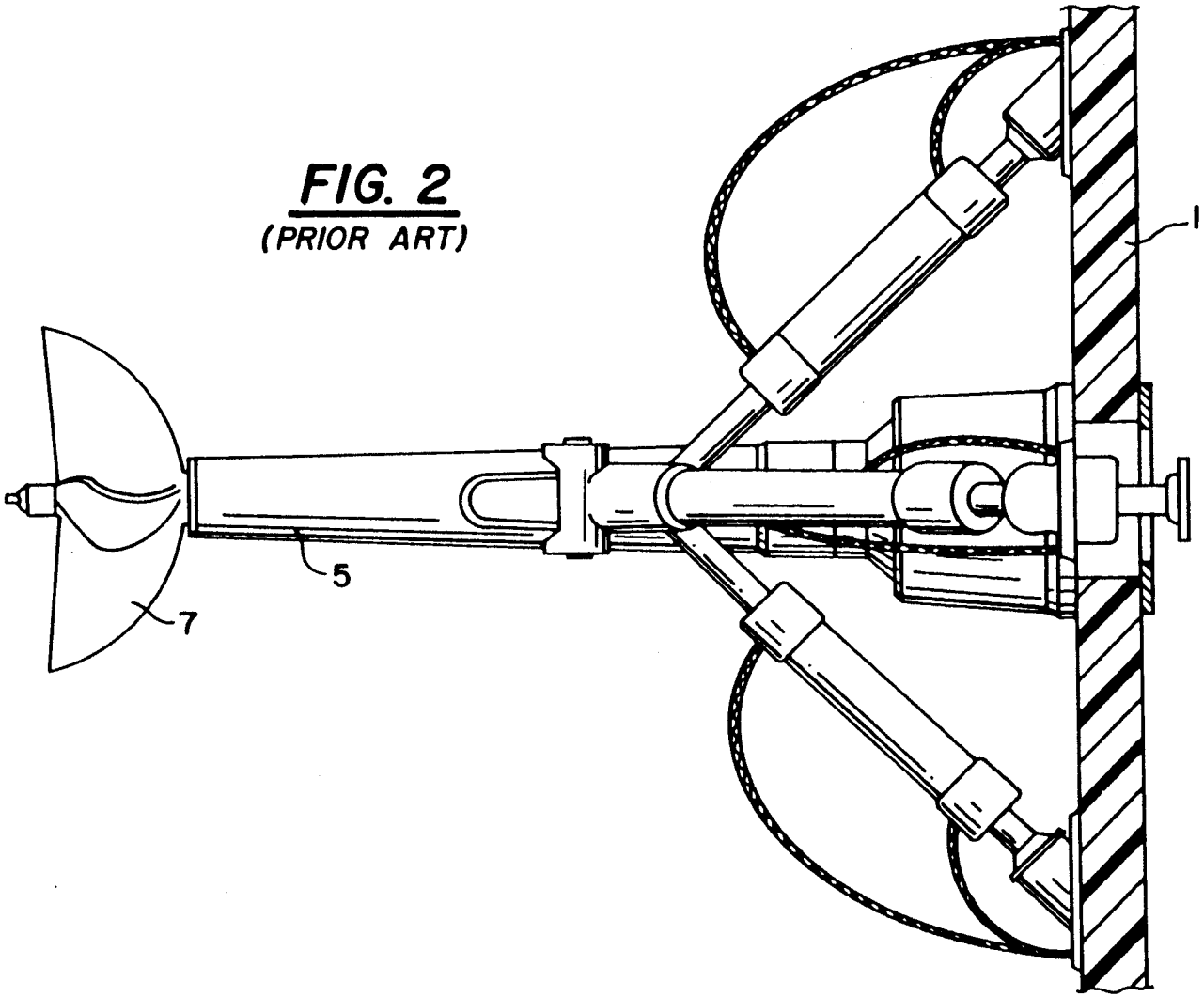
FIG. 2 (PRIOR ART)
FIG. 2 is a plan view of the propeller of FIG. 1.
Figure 3:
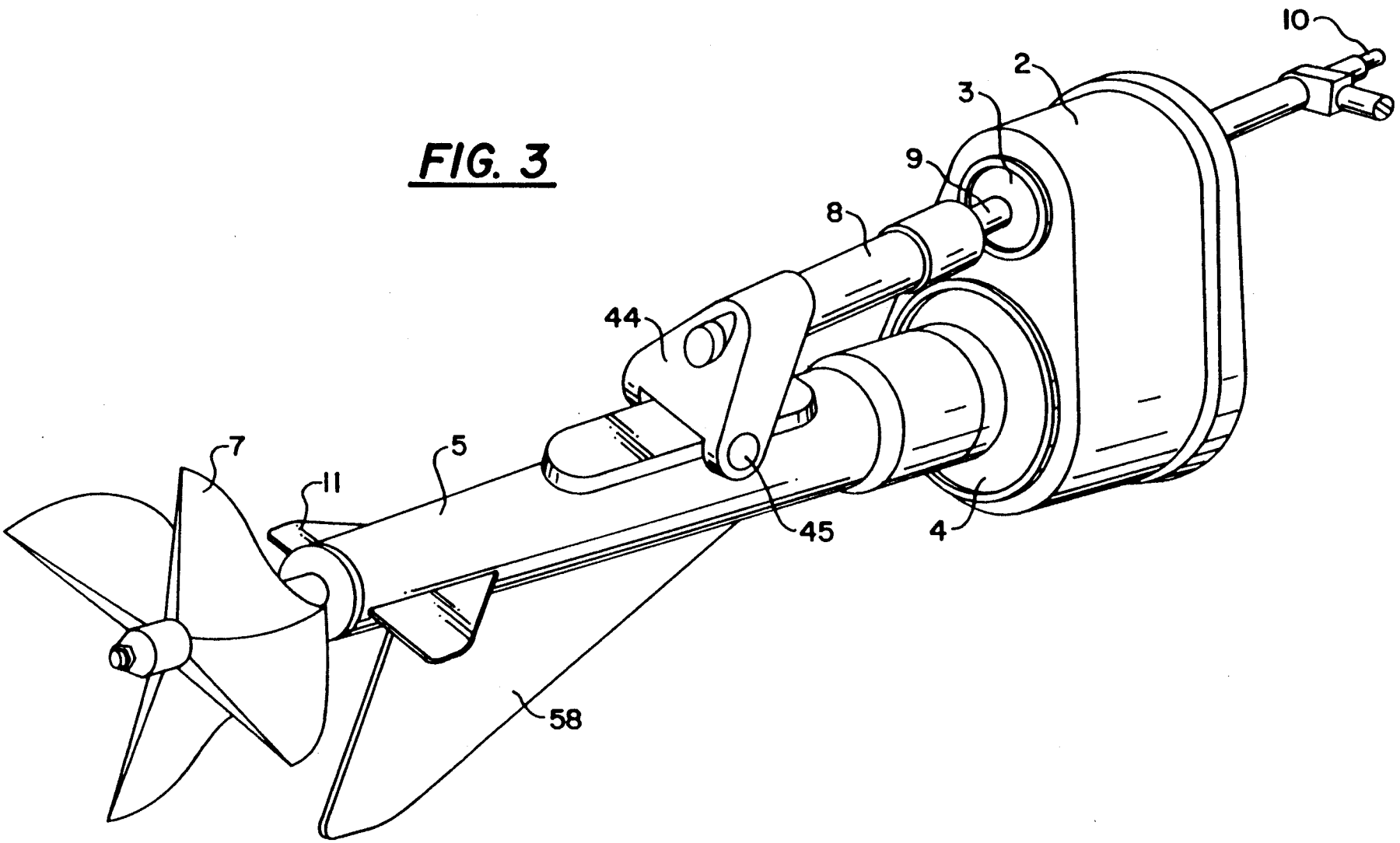
FIG. 3 is a perspective view of the propelling assembly provided in accordance with the principles of the present invention.
Figure 4:
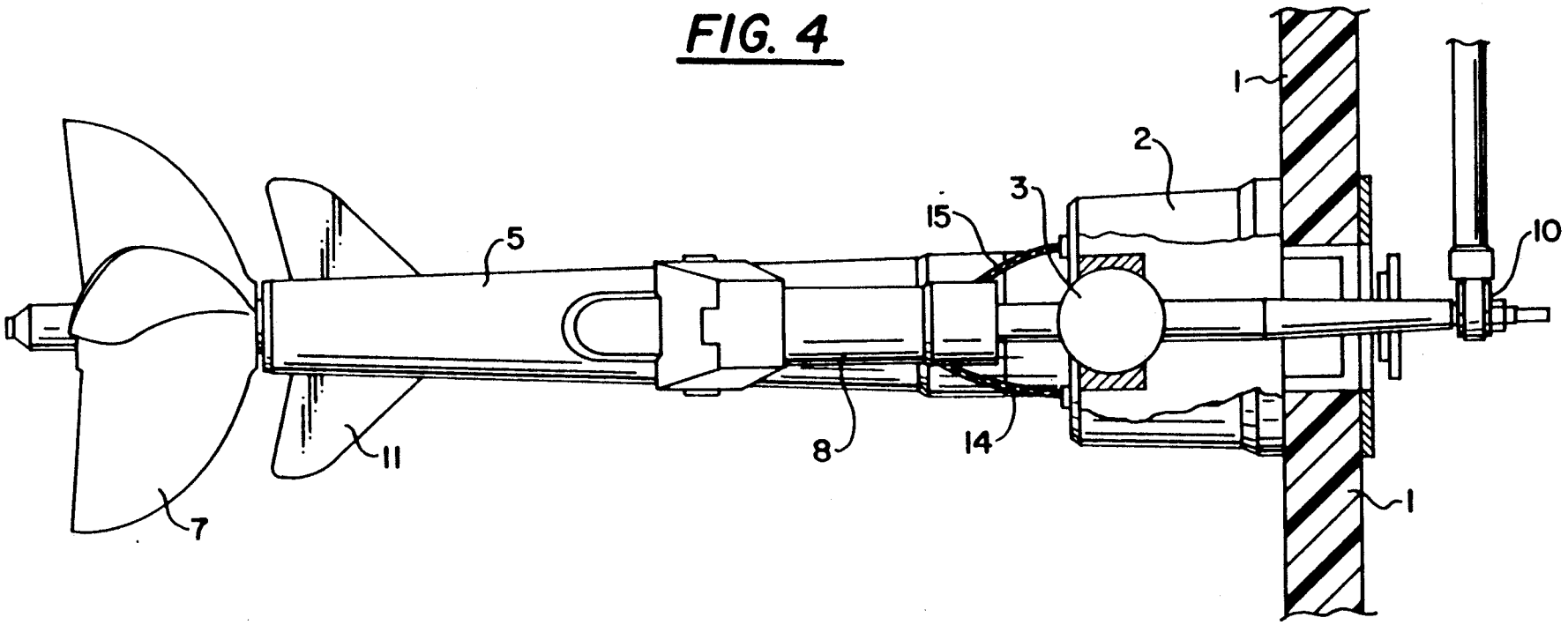
FIG. 4 is a plan view of the propelling assembly of the present invention.
Figure 5:
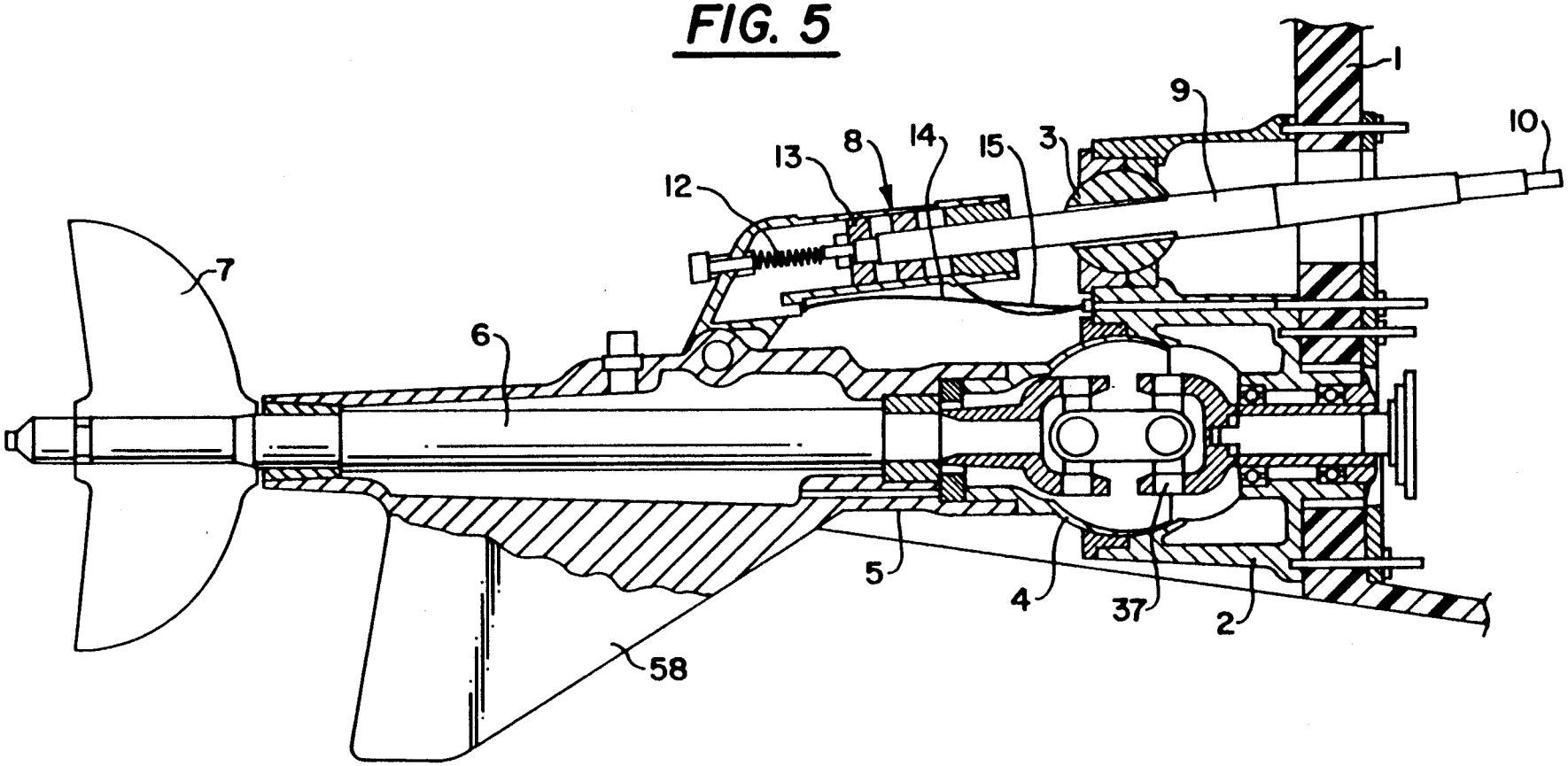
FIG. 5 is a sectional side view of the propelling assembly of FIG. 3.
Figure 6:
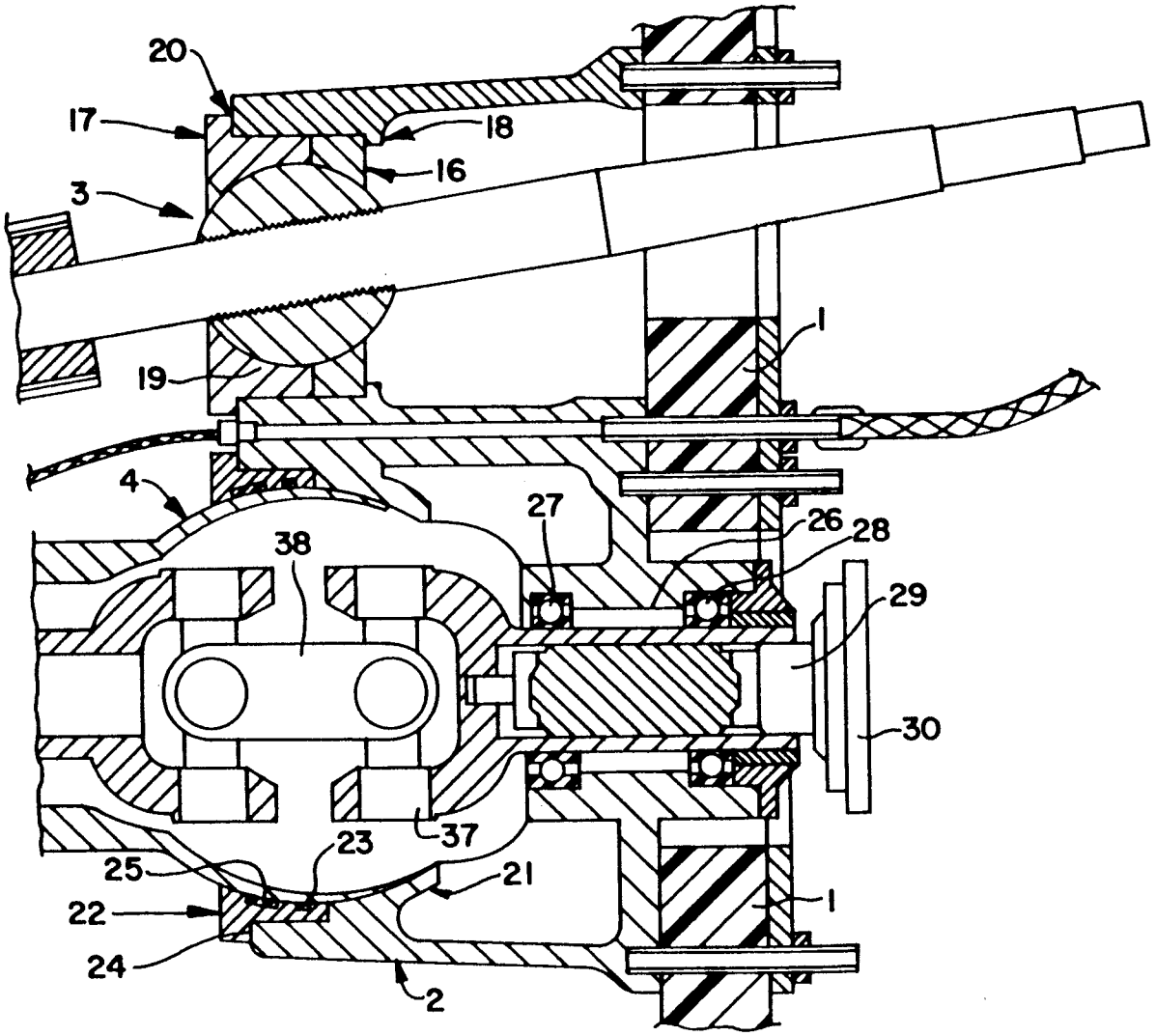
FIG. 6 is a sectional side view showing details of the support box of the present invention.

Referring to FIGS. 3–8, a propelling assembly, provided in accordance with the principles of the present invention is shown attached to the lower external side of the stern (1) in a single or multiple assembly and includes a support box (2) in which an articulation ball (3) and the thrust ball (4) are housed.

The propelling assembly also includes a propelling member (5) in which shaft (6) of the propeller (7) and the control system (8), which actuates the vertical and horizontal actuation of the propelling member (5), are attached. Horizontal motion is performed through rod extension (9) of the control system (8) that extends through the stern (1) where the steering actuation arm (10), which can be mechanically or mechanically/hydraulically operated, is received on the boats inner side.

Moreover, the control system (8) of the propelling assembly is provided with automatic adjustment means of the propelling member (5) submersion level relative to the water level, which adjusts the submersion of the propeller (7) according to the boat speed. Flaps (11) are arranged horizontally along the propelling member (5) in conjunction with the action of a gauging spring (12) installed within the control system (8), which is continuously pressed, so as to keep the propelling member (5) in the maximum submersion level. Manual submersion control is also provided by changing the relative position of the adjustment piston (47) through hydraulic actuation outside the propelling assembly, which will direct oil through oil lines (14) and (15) and will permit the adjustment of the submersion level in the desired positions, independently from the automatic adjustment action, which will become more apparent below.

The propelling assembly of the invention includes the articulation ball (3) and the thrust ball (4) integrated in a single member by the support box (2). The articulation ball (3) is housed in the upper portion of the support box (2) enclosed between two collars, an upper inner collar (16) and an upper flange (17), both forming a round recess which perfectly mates with the articulation ball (3). The upper collar is embedded into a backstop (18) of the support box (2) and the upper flange (17) is threaded in the support box to form a backstop against the upper inner collar (16). The upper flange (17) includes housing channels for the sealing rings (19) and (20), which prevent water from entering Housed in the lower portion of the support box (2) is the thrust ball (4) enclosed between the round recess (21) and the lower flange (22), both forming a round surface centered and accommodating the thrust ball (4). The lower flange (22) is threaded into the support box (2) forming a backstop against the round recess (21). The lower flange (22) includes housing channels for sealing rings and gaskets (23) and (24), which prevent water from entering and/or prevents leakage of lubricating oil included in the assembly The lower flange (22) further includes a second housing channel for a scraper ring (25) located in a forward position relative to the sealing ring or gasket. The round recess (21) of the support box is mated with the thrust ball (4) and with the cylindrical housing (26) of bearings (27) and (28) for inlet shaft (29) The cylindrical housing (26) extends through the stern (1) to receive the torque intake (30) coming from the engine.

Figure 7:
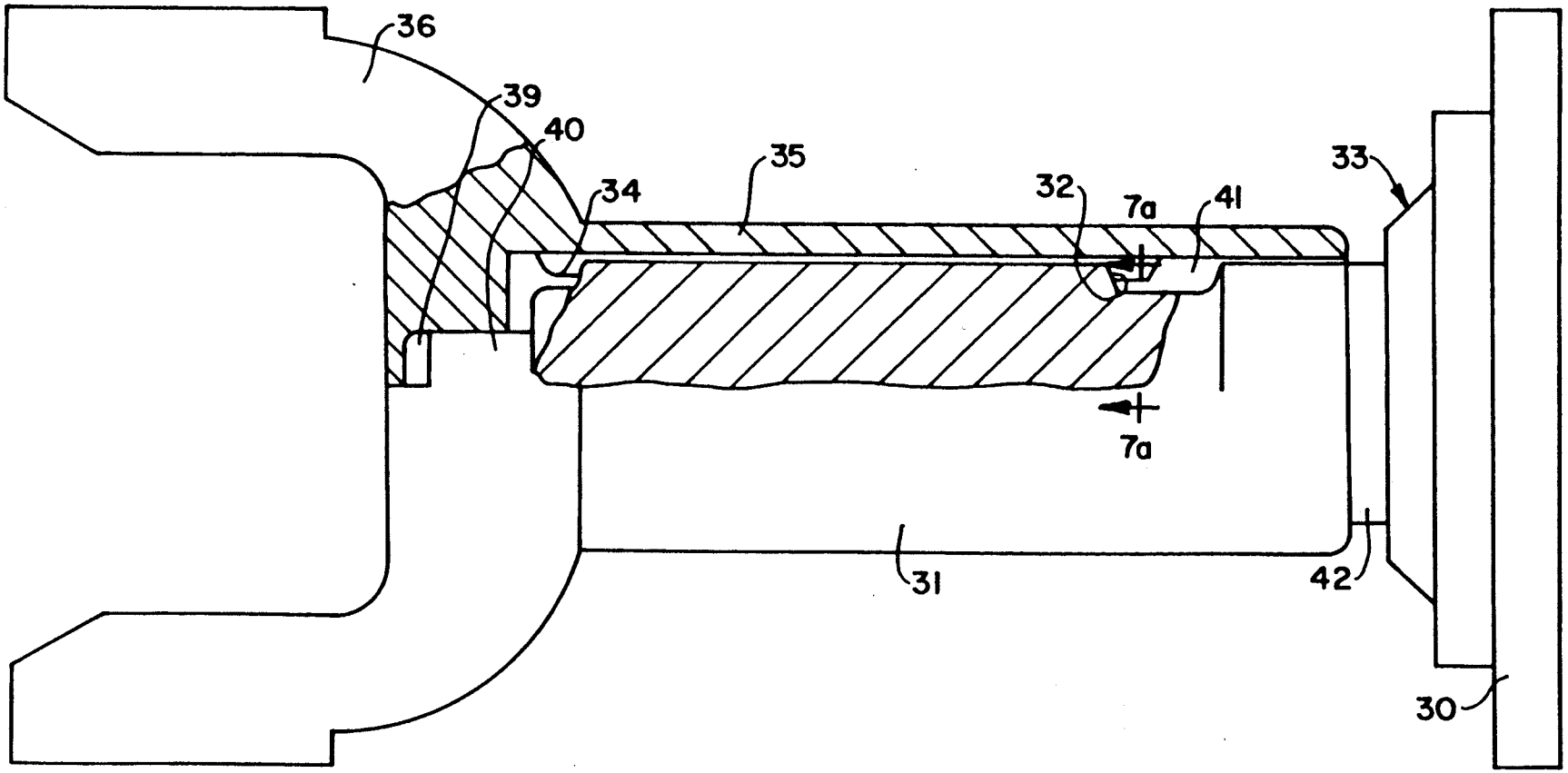
FIG. 7 is a partial sectional view of an inlet shaft and torque intake of the present invention.
Figure 7A:
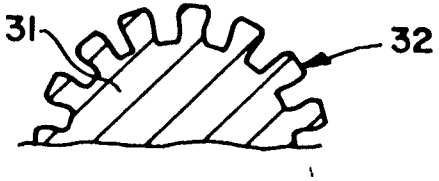
FIG. 7*a* is a sectional view taken along line 7*a*–7*a* of FIG. 7.

As shown in FIG. 7, the torque intake (30) includes a shaft (31) having longitudinal teeth (32) and a flange (33) at its end which form a single part. The longitudinal teeth slidingly interlock with inner slots (34) of the inlet shaft (35). The inlet shaft has a fork-shaped internal end (36) to which the crosshead (37) and the Cardan joint (38) are attached. The inlet shaft further includes a cylindrical housing (39) perfectly mated with end (40) of the torque intake (30) and another external cylindrical housing (41), located in a forward position relative to the internal slots (34), also perfectly mated with the external end (42) of the power take-off. The assembly is thus capable of transmitting torque through the slots (34), to absorb the flexion action on the supports (39), (41) of the ends and to limit the axial force due to the sliding movement into the internal slots (34).

As mentioned above, the propelling member (5) includes flaps (11) arranged lengthwise thereon at the end adjacent to the propeller (7), for generating a vertical upward force like that of a wing by the hydrodynamic action of the flaps moving across the water. The magnitude of the force is determined by a square function of boat speed and the vertical angle of member (5), and is used to raise the propelling member (5) in a self-adjusting process, where it is reduced the submersion level of the propeller (7) and consequently reduced its passive power, for better efficiency.

Figure 8:
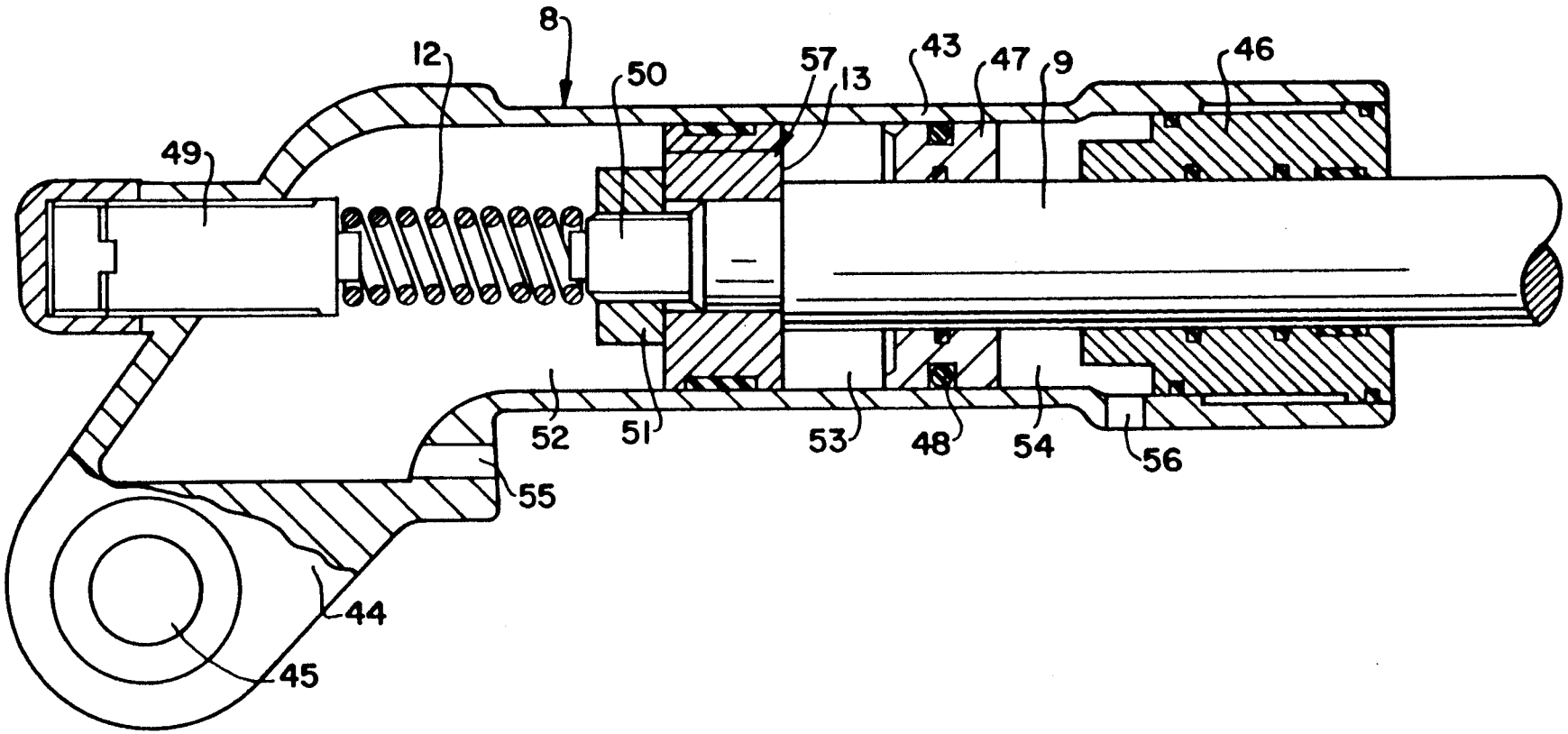
FIG. 8 is a sectional view of the submersion level actuation control system of the present invention.

As shown in FIG. 8, the control system (8) includes a cylinder (43) and a fork (44) assembled as a single part and attached to the propelling member (5) by a shaft (45) causing such two parts to rotate in an upright position by means of a cylindrically-shaped rod (9), to which internal end a guide-piston (13) is attached. The articulation ball (3), provided with an attaching flange, is rigidly fixed to the external portion of rod (9). Rod (9) includes an extension (10) to receive the actuation arm for a steering operation. A sealing bushing (46) is also provided, which is threaded into the cylinder (43). An adjustment piston (47) is provided in the internal part of the cylinder (43) and disposed so that it can simultaneously slide along the cylinder (43) walls and on the rod (9). Sealing rings or gaskets (48) and a spring (12) are also provided. The spring (12) is pressed by an adjusting screw (49) against rod (9) at end (50), to which the guide-piston (13) is attached Nut (51) fixes the guide piston (13 to end (50). Chambers (52), (53) and (54) are provided so that oil may be directed through oil lines (14), (15) which are connected to a manually driven pump installed outside the assembly. The spring continuously exerts compression forces from the fork (44) against the propelling member (5). An upward compression, which, in addition to self-weight action, keeps the propeller (7) at the maximum level of submersion, either when the boat is stationary or under lower speeds, when the hydrodynamic action of the flaps (11) is not able to overcome such compression. As boat speed increases, the hydrodynamical action of the flaps (11) also increase the upward compression in opposition to the spring (12) and to the self-weight force. To overcome these forces, compression of the spring occurs, the fork (44) and the cylinder (43) move along rod (9) towards the articulation ball (3), now stationary, which causes an upward rotation of the propelling member (5) which decreases the propeller (7) submersion and the flap (11) inclination angle. The above motion stops when a new position is reached and when the compression of the spring and self-weight are counterbalanced against the hydrodynamical force of the boat's speed, which is achieved by means of a new flap (11) inclination angle. The above motion slowly occurs due to flow resistance offered by the interconnection channel (57) in the guide-piston (13) when the oil is directed from the chamber (52) to the chamber (53), thus preventing sudden upward or downward motions.

The adjustment piston (13) and the guide-piston (47) can slide simultaneously within the cylinder (43) in response to a remotely controlled hydraulic pump disposed outside the assembly which directs pressurized oil to flow through channels (55) and (56). The adjustment piston (47) moves toward the guide piston (13) which forms a backstop, by directing pressurized oil through channel (56) and concomitantly by extracting the oil from the channel (55). By keeping the action of pressurized oil flow within the chamber (54), spring (12) will be compressed, creating the same aforesaid action of upward rotation of the propelling member (5) and decreasing the submersion of the propeller (7) by manual control up to the desired value, independent from the flaps (11) hydrodynamical action. The oil flow, when actuated under pressure in the opposite direction, causes the propelling member (5) to move downward and the propeller (7) to be submerged up to the desired intermediate level or until a maximum submersion level of the assembly is reached, which occurs when the adjustment piston (47) no longer exerts pressure against the guide-piston (13). The spring is thus totally stretched with the guide-piston (13) and the adjustment piston (47) forms a backstop against the sealing bush (46). As noted above, the spring (12) and the guide-piston (13) can perform the actions of self-adjustment in conjunction with the flaps (11), without using the hydraulic pump, adjustment piston (47) and manual control.

Thus, the innovations and improvements described in the present invention provide an economical and highly efficient propelling assembly, without the inconvenience of the conventional assemblies.

While the invention has been described in connection with what is presently considered to be the most practical and preferred embodiment, it is to be understood the invention is not limited to the disclosed embodiment , but, on the contrary, is intended to cover various modifications and equivalent arrangements included within the spirit and scope of the appended claims.

What is claimed is:

1. A boat propelling assembly comprising:

a propelling member having a thrust ball at an end thereof, a shaft and a propeller, said shaft being adapted to be coupled to an engine, a control arm having first and second coaxially disposed ends, a movable ball member being disposed between said first and second ends, said first end being movably coupled to said propelling member; and a support unit adapted to be coupled to an external lower side of a boat stern for housing said thrust ball of said propelling member and said movable ball member of said control arm so as to integrate articulation of said control arm and said propelling member to permit horizontal and vertical movement of said propelling member, said second end of said control arm being adapted to extend within an interior of a boat, movement of said second end of said control arm provides horizontal control of said propelling member so as to adjust steering, said control arm providing vertical control of said propelling member upon axial extension of said first end of said control arm so a to adjust propeller submersion.

2. A boat propelling assembly according to claim 1, wherein a rod member extends from said movable ball member and is adapted to extend into said interior of a boat so as to define said second end of said control arm.

3. A boat propelling assembly according to claim 2, wherein said movable ball member is housed within an upper portion of said support unit between first and second collars, said collars forming a round recess which mates with said movable ball member, said first collar being internally embedded into a backstop of said support unit, said second collar being threaded into said support unit forming a backstop against the first collar, said second collar including channels wherein sealing rings are disposed 4. A boat propelling assembly according to claim 1, wherein the thrust ball member of the propelling member is housed in a lower portion of the support unit between a round recess thereof and a collar which is threaded into said support unit, said round recess and said threaded collar mating with the thrust ball member, said threaded collar forming a backstop against a projection of the round recess, said threaded collar including housing channels wherein sealing elements are disposed.

5. A boat propelling assembly according to claim 4, wherein said round recess is axially aligned with a cylindrical housing of a rotatable inlet shaft, said cylindrical housing forming a projection in the support unit which is adapted to extend through the boat stern to receive a torque intake member coupled to an engine, said torque intake member being coupled to said propelling member for driving said propeller.

6. A boat propelling assembly according to claim 5, wherein the torque intake includes a shaft having longitudinal teeth and a flange at the end thereof so as to form a single part, said longitudinal teeth slidingly interlocking internal slots of an inlet hollow shaft, an internal end of said inlet hollow shaft being fork-shaped, a cross-head of a universal joint being coupled to said forked-shaped end, said inlet hollow shaft further including a cylindrical housing mated to an end of the torque intake, and another external cylindrical housing placed in a forward position to internal slots which are mated with an external end of a power take-off device.

7. A boat propelling assembly according to claim 1, wherein the propelling member includes flaps extending longitudinally along a surface thereof adjacent to the propeller, and a rudder extending vertically downward from said propelling member, substantially perpendicular to said flaps 8. A boat propelling assembly according to claim 1, wherein the control arm includes:

a cylinder and a fork which are connected to the propelling member by means of a shaft at said first nd of said control arm allowing vertical movement of said cylinder and said fork;

a rod member having first and second ends and a central portion, said first end thereof being coupled to a guide-piston, the movable ball member being disposed about said central portion and being coupled to said support unit, said second end of said rod adapted to receive a steering actuator;

a sealing bushing threaded into said cylinder for sealing said rod member;

an adjustment piston disposed within said cylinder for simultaneous sliding movement along walls of said cylinder and over said rod member; and a spring compressed between an adjustment screw and said first end said rod member, said cylinder including chambers, said chambers being coupled to channels, said channels delivering oil to said chambers from an external source.

9. A boat propelling assembly according to claim 8, wherein said spring exerts a continuous downward force on the fork against the propelling member so that the propeller is maintained in a maximum submersion position.

10. A boat propelling assembly according to claims 8, wherein said adjustment piston is moved by said externally supplied oil to form a backstop against said guide-piston so as to compress said spring to actuate lifting vertical motion of the propelling member.

11. A boat propelling assembly comprising:

a propelling member having a thrust ball at an end thereof, a shaft and a propeller, said shaft being adapted to be coupled to an engine, a control arm having first and second coaxially disposed ends and a movable ball member disposed between said first and second ends at a central portion thereof, said first end being movably coupled to said propelling member; and a support unit adapted to be coupled to an external lower side of a boat stern, the movable ball member of said control arm being movably supported by an upper portion of said support unit, the thrust ball of said propelling member being movably supported by a lower portion of said support unit, said support unit integrating articulation of said control arm and said propelling member so as to permit horizonal and vertical movement of said propelling member, said second end of said control arm being adapted to extend within an interior of a boat, said control arm including a control assembly permitting (1) horizontal control of said propelling member so as to adjust steering by movement of said second end of said control assembly and (2) vertical control of said propelling member by axial movement of said first end of said control arm so as to adjust propeller submersion.

12. A boat propelling assembly according to claim 11, wherein said control assembly includes:

a cylinder and a fork which and connected to the propelling member by means of a shaft at said first end of said control arm allowing vertical rotation of said cylinder and said fork;

a rod member having first and second ends and a central portion, said first end thereof being coupled to a guide-piston, the movable ball member being disposed about said central portion and being coupled to said support unit, said second end of said rod adapted to receive a steering actuator;

a sealing bushing threaded into said cylinder for sealing said rod member;

an adjustment piston disposed within said cylinder for simultaneous sliding movement along walls of said cylinder and over said rod member; and a spring compressed between an adjustment screw and said first end said rod member, said cylinder including chambers, said chambers being coupled to channels, said channels delivering oil to said chambers from an external source.

13. A boat propelling assembly comprising:

a propelling member having a shaft and a propeller, said shaft being adapted to be coupled to an engine, a control arm having first and second coaxially disposed ends, said first end being movably coupled to said propelling member; and a support unit adapted to be coupled to a boat stern for supporting a portion of each said propelling member and said control arm so as to permit horizonal and vertical movement of said propelling member, said second end of said control arm being adapted to extend within an interior of a boat, movement of said second end of said control arm provides horizontal control of said propelling member so as to adjust steering, said control arm providing vertical control of said propelling member so as to adjust propeller submersion, said control arm being coupled to said support unit by a movable ball member, a rod member extending from said ball member and being adapted to extend into said interior of a boat so as to define said second end of said control arm.

14. A boat propelling assembly according to claim 13, wherein said movable ball member is housed within an upper portion of said support unit between first and second collars, said collars forming a round recess which mates with said movable ball member, said first collar being internally embedded into a backstop of said support unit, said second collar being threaded into said support unit forming a backstop against the first collar, said second collar including channels wherein sealing rings are disposed.

15. A boat propelling assembly comprising:

a propelling member having a shaft and a propeller, said shaft being adapted to be coupled to an engine, a control arm having first and second coaxially disposed ends, said first end being movably coupled to said propelling member; and a support unit adapted to be coupled to a boat stern for supporting a portion of each said propelling member and said control arm so as to permit horizontal and vertical movement of said propelling member, said second end of said control arm being adapted to extend within an interior of a boat, movement of said second end of said control arm provides horizontal control of said propelling member so as to adjust steering, said control arm providing vertical control of said propelling member so as to adjust propeller submersion, said propelling member and said control arm being movably coupled to said support unit by separate ball members.

16. A boat propelling assembly comprising:

a propelling member having a shaft and a propeller, said shaft being adapted to be coupled to an engine, a control arm having first and second coaxially disposed ends, said first end being movably coupled to said propelling member; and a support unit adapted to be coupled to a boat stern for supporting a portion of each said propelling member and said control arm so as to permit horizonal and vertical movement of said propelling member, said second end of said control arm being adapted to extend within an interior of a boat, movement of said second end of said control arm provides horizontal control of said propelling member so as to adjust steering, said control arm providing vertical control of said propelling member so as to adjust propeller submersion, said propelling member being movably coupled to said support unit by a thrust ball member, said thrust ball member of the propelling member being housed in a lower portion of the support unit between a round recess thereof and a collar which is threaded into said support unit, said round recess and said threaded collar mating with the thrust ball member, said threaded collar forming a backstop against a projection of the round recess, said threaded collar including housing channels wherein sealing elements are disposed.

17. A boat propelling assembly according to claim 16, wherein said round recess is axially aligned with a cylindrical housing of a rotatable inlet shaft, said cylindrical housing forming a projection in the support unit which is adapted to extend through the boat stern to receive a torque intake member coupled to an engine, said torque intake member being coupled to said propelling member for driving said propeller.

18. A boat propelling assembly according to claim 17, wherein the torque intake includes a shaft having longitudinal teeth and a flange at the end thereof so as to form a single part, said longitudinal teeth slidingly interlocking internal slots of an inlet hollow shaft, an internal end of said inlet hollow shaft being fork-shaped, a crosshead of a universal joint being coupled to said forked-shaped end, said inlet hollow shaft further including a cylindrical housing mated to an end of the torque intake, and another external cylindrical housing placed in a forward position to internal slots which are mated with an external end of a power take-off device.

19. A boat propelling assembly comprising:

a propelling member having a shaft and a propeller, said shaft being adapted to be coupled to an engine, a control arm having first and second coaxially disposed ends, said first end being movably coupled to said propelling member, said control arm including:

a cylinder and a fork which and connected to the propelling member by means of a shaft at said first end of said control arm allowing vertical rotation of said cylinder and said fork;

a rod member having first and second ends and a central portion, said first end thereof being coupled to a guide-piston, a movable ball member being disposed about said central portion and being coupled to said support unit, said second end of said rod adapted to receive a steering actuator;

a sealing bushing threaded into said cylinder for sealing rod member;

an adjustment piston disposed within said cylinder for simultaneous sliding movement along walls of said cylinder and over said rod member; and a spring compressed between an adjustment screw and said first end said rod member, said cylinder including chambers, said chambers being coupled to channels, said channels delivering oil to said chambers from an external source; and a support unit adapted to be coupled to a boat stern for supporting a portion of each said propelling member and said control arm so as to permit horizonal and vertical movement of said propeller member, said second end of said control arm being adapted to extend within an interior of a boat, movement of said second end of said control arm provides horizontal control of said propelling member so as to adjust steering, said control arm providing vertical control of said propelling member so as to adjust propeller submersion.

20. A boat propelling assembly according to claim 19, wherein said spring exerts a continuous downward force on the for against the propelling member so that the propeller is maintained in a maximum submersion position.

21. A boat propelling assembly according to claim 19, wherein said adjustment piston is moved by said externally supplied oil to form a backstop against said guide-piston so as to compress said spring to actuate lifting vertical motion of the propelling member.

22. A boat propelling assembly comprising:

a propelling member having a shaft and a propeller, said shaft being adapted to be coupled to an engine;

a control arm having first and second coaxially disposed ends, said first end being movably coupled to said propelling member; and a support unit adapted to be coupled to a boat stern, a central portion of said control arm being movably supported by an upper portion of said support unit, a central portion of said propelling member being movably supported by a lower portion of said support unit so as to permit horizonal and vertical movement thereof, said second end of said control arm being adapted to extend within an interior of a boat, said control arm including a control assembly permitting (1) horizontal control of said propelling member so as to adjust steering by movement of said second end of said control assembly and (2) vertical control of said propelling member so as to adjust propeller submersion, said central portions of each said propelling member and said control arm being movably coupled to said support unit by separate ball members.

23. A boat propelling assembly comprising:

a propelling member having a shaft and a propeller, said shaft being adapted to be coupled to an engine, a control arm having first and second coaxially disposed ends, said first end being movably coupled to said propelling member, said control assembly including:

a cylinder and a fork which and connected to the propelling member by means of a shaft at said first end of said control arm allowing vertical rotation of said cylinder and said fork;

a rod member having first and second ends and a central portion, said first end thereof being coupled to a guide-piston, a movable ball member being disposed about said central portion and being coupled to said support unit, said second end of said rod adapted to receive a steering actuator;

a sealing bushing threaded into said cylinder for sealing said rod member;

an adjustment piston disposed within said cylinder for simultaneous sliding movement along walls of said cylinder and over said rod member; and a spring compressed between an adjustment screw and said first end said rod member, said cylinder including chambers, said chambers being coupled to channels, said channels delivering oil to said chambers from an external source; and a support unit adapted to be coupled to a boat stern, a central portion of said control arm being movably supported by an upper portion of said support unit, a central portion of said propelling member being movably supported by a lower portion of said support unit so as to permit horizonal and vertical movement thereof, said second end of said control arm being adapted to extend within an interior of a boat, said control arm including a control assembly permitting (1) horizontal control of said propelling member so as to adjust steering by movement of said second end of said control assembly and (2) vertical control of said propelling member so as to adjust propeller submersion.

* * * * *

UNITED STATES PATENT AND TRADEMARK OFFICE

CERTIFICATE OF CORRECTION

PATENT NO. : 5,290,182
DATED : March 1, 1994
INVENTOR(S) : MONDELOP

It is certified that error appears in the above-indentified patent and that said Letters Patent is hereby corrected as shown below:

On the Title Page, under Item [19], "Mondelop" shoul be --Mondelo--.

Please Change:

"[76] Inventor: J. Luis A. Mondelop, R. Carvalho . . ."

to —[76] Inventor: J. Luis A. Mondelo, R. Carvalho . . .---

Signed and Sealed this

Twelfth Day of July, 1994

Bruce Lehman

*Attest:*

BRUCE LEHMAN

*Attesting Officer*

*Commissioner of Patents and Trademarks*